US005513899A

United States Patent [19]

Michaels et al.

[11] Patent Number: 5,513,899

[45] Date of Patent: May 7, 1996

[54] SEAT CUSHION FOR WHEELCHAIRS

[75] Inventors: Gregory A. Michaels, Seven Hills; David D. Polacsek, Elyria, both of Ohio

[73] Assignee: Invacare Corporation, Elyria, Ohio

[21] Appl. No.: 129,783

[22] Filed: Sep. 29, 1993

Related U.S. Application Data

[63] Continuation of Ser. No. 791,259, Nov. 13, 1991, abandoned.

[51] Int. Cl.[6] ..... A47C 7/02

[52] U.S. Cl. ..... 297/452.41; 297/452.25; 297/452.55

[58] Field of Search ..... 297/452.21, DIG. 3, 297/452.1, 452.29, 218, 452.41, 219.1, 180.1, 186.15, 283, 312, 105, 284.6, 452.25, 440.1, 218.1, 283.1, 452.55, DIG. 4; 5/450, 451, 455, 909

[56] References Cited

U.S. PATENT DOCUMENTS

| | | | |
|---|---|---|---|
| 3,402,411 | 9/1968 | Hanson . | |
| 3,407,406 | 10/1968 | Werner et al. | 2/3 |
| 3,787,908 | 1/1974 | Beck et al. | 5/451 |
| 3,858,379 | 1/1975 | Graves | 5/450 X |
| 3,968,530 | 7/1976 | Dison | 5/450 |
| 3,986,213 | 10/1976 | Lynch | 5/450 X |
| 4,038,762 | 8/1977 | Swan, Jr, | 36/89 |
| 4,108,928 | 8/1978 | Swan, Jr, | 264/26 |
| 4,144,658 | 3/1979 | Swan, Jr, | 36/117 |
| 4,163,297 | 8/1979 | Neumark | 5/451 X |
| 4,174,420 | 11/1979 | Arolick et al. | 297/452 X |
| 4,229,546 | 10/1980 | Swan, Jr, | 521/55 |
| 4,243,754 | 1/1981 | Swan, Jr. | 521/55 |
| 4,255,202 | 3/1981 | Swan, Jr. | 106/122 |
| 4,411,033 | 10/1983 | Morgan | 5/451 X |
| 4,425,676 | 1/1984 | Crane | 5/453 X |
| 4,588,229 | 5/1986 | Jay | 297/459 |
| 4,660,238 | 4/1987 | Jay | 5/431 |
| 4,726,024 | 2/1988 | Jay | 292/459 |
| 4,726,624 | 2/1988 | Jay | 297/459 |
| 4,728,551 | 3/1988 | Jay | 428/76 |
| 4,744,601 | 5/1908 | Nakanishi | 297/DIG. 2 X |
| 4,761,843 | 8/1988 | Jay | 5/431 |
| 4,788,730 | 12/1988 | Bexton | 5/909 X |
| 4,842,330 | 6/1989 | Jay | 297/4 |
| 5,123,985 | 6/1992 | Evans et al. | 156/382 X |

*Primary Examiner*—Milton Nelson, Jr.

*Attorney, Agent, or Firm*—Fay, Sharpe, Beall, Fagan, Minnich & McKee

[57] ABSTRACT

A filled envelope for use with a shaped tray in a wheelchair comprises upper and lower elastomeric elements. The elements have seals about their edges to create a finite volume. The volume is filled with a fill material which comprises petrolatum and hollow glass spheres. The volume of petrolatum comprising the fill material is not substantially greater than the volume of the interstitial spaces of a quantity of hollow glass spheres alone. The envelope also has additional seals which separate the envelope into quadrants to improve the stability of the cushion to the user.

8 Claims, 2 Drawing Sheets

SEAT CUSHION FOR WHEELCHAIRS

This is a continuation of application Ser. No. 07/791,259 filed on Nov. 13, 1991, and now abandoned.

BACKGROUND OF THE INVENTION

1. Field of Invention

This invention pertains to the field of wheelchairs and more particularly to the field of seat cushions incorporating gel-filled envelopes for use in wheelchairs and the like.

2. Description of Related Art

Persons who are required to sit or recline in chairs, wheelchairs, recliners, or beds for long periods of time are prone to develop sores on those portions of their bodies where their body weight is borne. Users of wheelchairs are susceptible to these sores in the area of their buttocks and thighs due to the fact that nearly all of their weight is distributed over a relatively small area.

For this reason, wheelchair cushions have been developed to spread the weight of the person's body over a larger area and reduce the possibility of such sores. Among these seat cushions are those utilizing shaped trays. Such shaped trays are commonly made out of foam and are configured with recesses to receive various parts of the user's body, such as the buttocks region and the legs. In some designs, an envelope full of a flowable gel is utilized along with a shaped tray. In these designs, an envelope, usually elastomeric, is filled with a flowable gel material which is displaceable under the weight of the user's body.

Some examples of gel-filled envelopes include U.S. Pat. Nos. 4,842,330; 4,726,624; 4,588,229; 4,660,238; and 4,761,843, all to Jay. In addition, patents disclosing viscous, flowable, pressure compensating type gels used in products other than seat cushions include U.S. Pat. Nos. 4,243,754; 4,108,928; 4,144,658; 4,229,546; 4,255,202, all to Swann, Jr. and U.S. Pat. No. 3,402,411 to Hanson.

Although some of these designs performed adequately, improvements were desirable. For example, some of the gels incorporated in such elastomeric envelopes had a tendency to bleed through the envelope and stain fabric seat covers and the clothing of the wheelchair user. In addition, some gels were composed of two or more components and the components had a tendency to separate during the life of the product.

The present inventive seat cushion is a new and improved seat cushion which overcomes the foregoing difficulties and others while providing better and more advantageous overall results.

SUMMARY OF THE INVENTION

In accordance with the present invention, a new and improved seat cushion is provided which is adapted to be used by persons sitting for long periods of time.

More particularly, a filled envelope for use with an associated chair such as a wheelchair, stationary seating chair, folding chair and the like, comprises upper and lower elements having edges about their peripheries. The edges are selectively sealed to form a closed envelope having a finite volume. The envelope is filled with fill material. The fill material is flowably displaceable under the weight of an associated user. The fill material comprises petrolatum. The preferred petrolatum is manufactured by Pennzoil Products Co. under the tradename Penreco® Amber.

According to another aspect of the present invention, the envelope also comprises lightening means. The lightening means has a low weight density and is interspersed within the petrolatum to decrease the weight of the envelope. In a preferred embodiment, the lightening means comprises hollow glass spheres. In the preferred embodiment, the percent by volume of the spheres within the envelope is approximately equal to the percent by volume of the petrolatum.

According to another aspect of the present invention, the envelope comprises fill spouts in the edges about the periphery of the upper and lower elements. The fill spouts selectively receive petrolatum during a filling process and are subsequently sealed, preferably by a heat sealing technique.

According to another aspect of the present invention, a seat cushion for use in a wheelchair comprises a Shaped tray and an envelope. The shaped tray has an upper surface which has recesses to selectively receive the buttocks and thighs of a user of an associated wheelchair. The envelope comprises upper and lower surfaces and is filled with a fill material comprising petrolatum and hollow spheres. The volume of the petrolatum within the envelope is not substantially greater than the volume of the interstitial spaces of a quantity of hollow glass spheres alone. The terminology "substantially greater than" is defined as greater than fifty percent (50%) with respect to the interstitial volume calculated using the average bulk density and the average true density.

According to another aspect of the present invention, the petrolatum has a specific density of 0.86 at 60° F. and a melting range of 122° F. to 135° F. and a semi-solid appearance.

One advantage of the present invention is the low cost of the fill material. The fill material is commonly available from many suppliers and can be easily purchased.

Another advantage of the present invention is the low manufacturing and inventory cost due to the fact that the fill material comprises a single component to be mixed with the hollow spheres, rather than two or more components to be mixed with the spheres.

Another advantage of the present invention is the stability of the gel during the life of the product. Since it is made of a single material, there is no opportunity for two or more components to separate, as has been found in some prior art designs.

Another advantage of the present invention is its ability to stay within the elastomeric envelope and not leak out, thus staining the fabric seat cover or clothes of the wheelchair user.

Still other benefits and advantages of the present invention will become apparent to those skilled in the art upon a reading and understanding of the following detailed specification.

BRIEF DESCRIPTION OF THE DRAWINGS

The invention may take physical form in certain parts and arrangements of parts, a preferred embodiment of which will be described in detail in this specification and illustrated in the accompanying drawings, wherein.

DESCRIPTION OF THE PREFERRED EMBODIMENT

Figure 1:
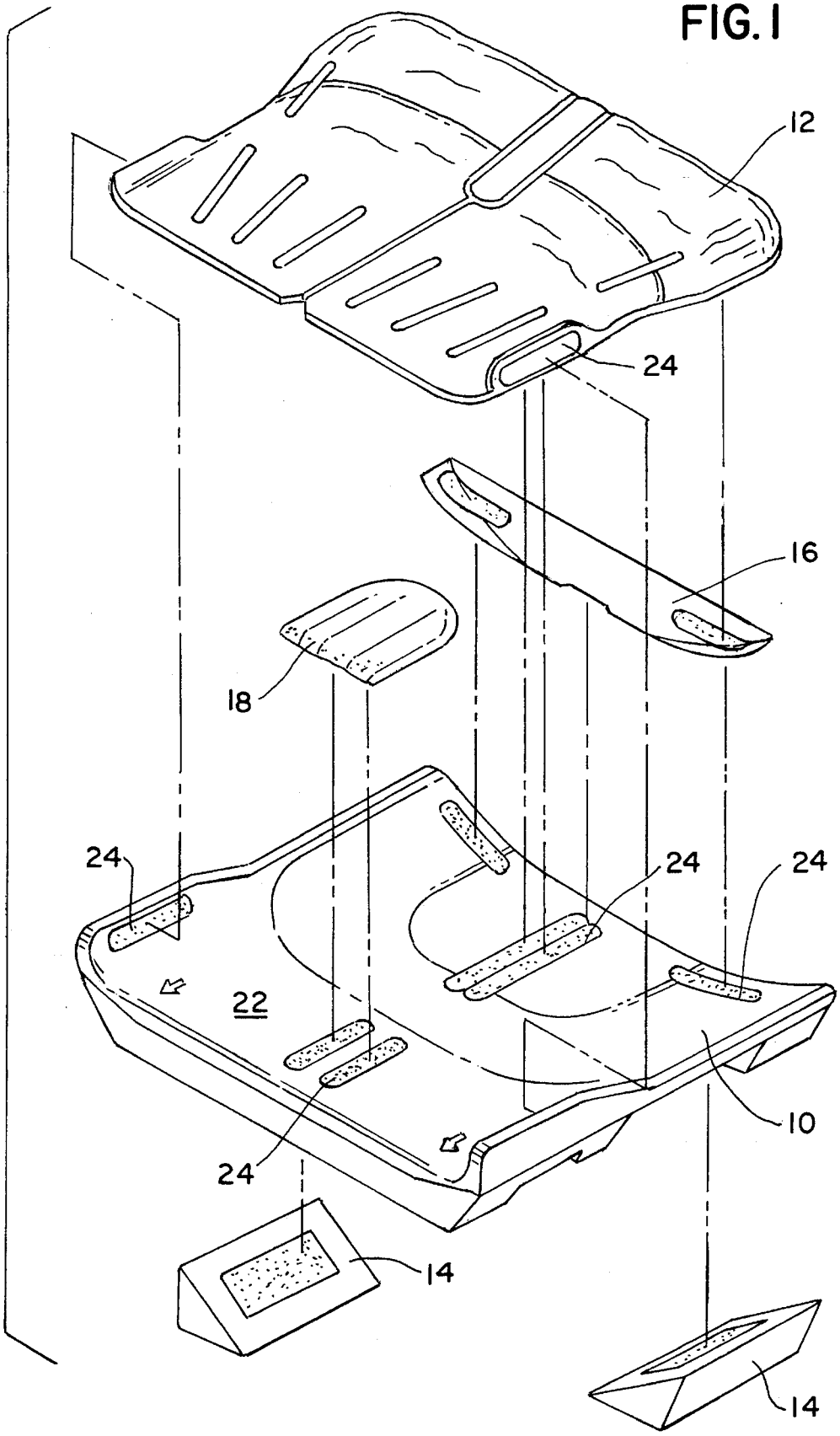
FIG. 1 shows an exploded perspective view of a shaped tray and envelope according to the invention; and, FIG. 2 shows a plan view of an envelope according to the invention.

Referring now to the drawings wherein the showings are for purposes of illustrating a preferred embodiment of the invention only and not for purposes of limiting the same, FIG. 1 shows an exploded perspective view of a seat cushion according to the invention. A shaped tray 10 has components of side wedges 14, a back wedge 16, and an abductor 18. An envelope 12 is attached to an upper surface 22 of the shaped tray 10 via hook and loop strips 24. Corresponding hook and loop strips 24 are located on the bottom surface of the envelope 12. These hook and loop strips 24 enable the envelope 12 to be repeatedly attached and removed from the shaped tray 10. The features of the shaped tray, such as its configuration, the side wedges 14, the back wedge 16, and the abductor 18, are not features of the present invention, but are only illustrated to indicate the environment in which the invention is typically used.

Figure 2:
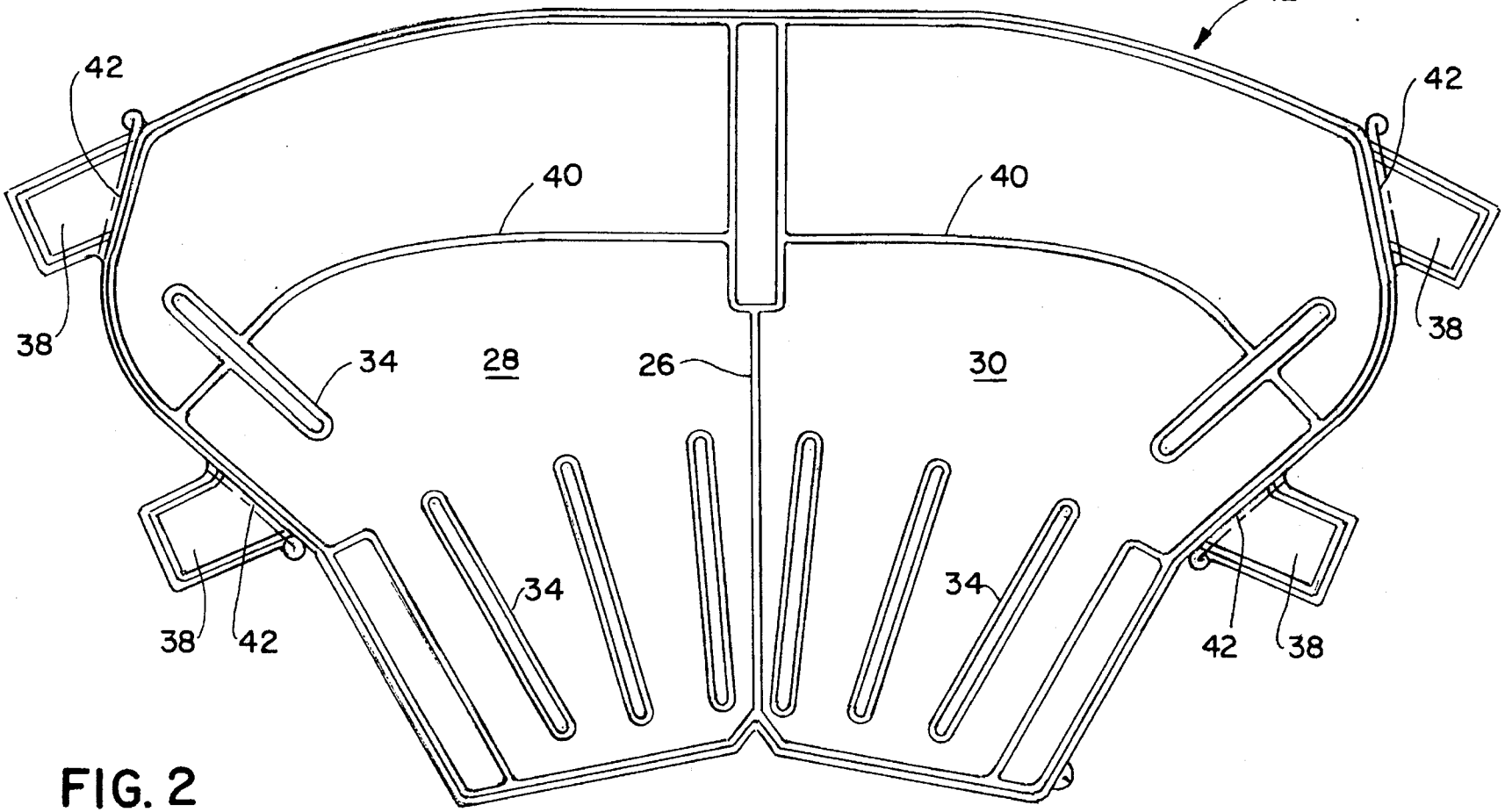

With reference to FIG. 2, an envelope 12 according to the invention is shown in plan view. In the preferred embodiment, the envelope 12 is split into right and left portions by seam 26. Seam 26 prevents the flow of fill material from the right side 28 to the left side 30 and vice versa. This prohibition of flow adds to the stability of the envelope 12 by preventing movement or slumping by the user from forcing a large portion of the fill material to one side of the envelope 12 to the other side.

Additional seams 34 restrict the flow of fill material within the right or left side 28, 30 of the envelope 12. Seams 40 further restrict flow. Typically, the seams 26, 34 and 40 are formed through a heat sealing apparatus or process.

In the preferred embodiment, the envelope 12 is made of a urethane blown film which is 0.006" thick.

In the preferred embodiment, the envelope 12 is filled with fill material via fill spouts 38. Because the envelope 12 is split into quadrants via seams 26, 40, four fill spouts 38 are required. After the fill spouts 38 have been used to fill each quadrant with an appropriate amount of fill material, the fill spouts 38 are permanently sealed via heat seals.

The fill material has two primary components. The preferred petrolatum is Penreco® Amber petrolatum, and can be purchased from Pennzoil Products Co. This petrolatum is a mixture of a hydrocarbon oil and wax. The petrolatum or petroleum jelly is a microcrystalline wax with a defined oil content. Microcrystalline waxes consist mainly of iso and cycloparaffins with some alkylated aromatic hydrocarbons. Petrolatums are non-toxic and some petrolatums have been approved for food and medicinal uses. Petrolatums have consistencies at 77° F. USP and ASTM D937 between 35 and 410 with melting ranges between 95° F. and 170° F. The presently preferred petrolatum has a semi-solid appearance and is odorless. It has a melting range of 122° F. to 135° F. according to ASTM D127 and has a specific gravity of 0.86 at 60° F. The density of the petrolatum ranges from 0.83 gm/cc–0.87 gm/cc. Its viscosity, SUS@210° F., is between 68 and 82. Its maximum lovibond color (2" cell) is 35Y7R. Its consistency at 77° F. USP and ASTM D937 is between 175 and 250. Its typical congealing point is 123° F., according to ASTM D938.

A second component of the fill material is hollow glass spheres. In the preferred embodiment, these spheres are Scotchlite® glass bubbles, available from 3M® Corporation. The type utilized in the preferred embodiment is 3M® designation C15/250, having an average true density of 0.15 grams/cc. (9.4 lbs./cu.ft), but ranging between 0.12–0.18 grams/cc., and a bulk density range of 0.07–0.12 grams/cc. Their size is a maximum of 5% by weight +US 80 mesh (177 microns).

While a spherical shape is the preferred shape of the lightening material, other shapes, such as columns, rectangles, triangles, ovals, etc. can be utilized successfully.

In the preferred embodiment, the fill material is produced by mixing four 50 pound boxes of 3M® Scotchlite glass bubbles with three 55 gallon drums of the Penreco® Amber petrolatum. The resulting fill material is comprised of approximately 49.2% glass bubbles by volume and 50.8% petrolatum by volume. In such a case, the volume of petrolatum comprising the fill material is not substantially greater than the volume of the interstitial spaces of the quantity of glass beads alone which, based on manufacturer-supplied information, can be as great as 62% by volume depending upon the bulk density and true density of the 3M® type C15/250 glass bubbles present in a specific batch. If the amount of petrolatum greatly exceeds the interstitial spaces between the spheres, the feel of the envelope 12 becomes too fluid for applicant's preference. If the amount of petrolatum is greatly less than the interstitial spaces between the spheres, the envelope has a hard feel.

The invention has been described with reference to a preferred embodiment. Obviously, modifications and alternations will occur to others upon a reading and understanding of this specification. It is intended to include all such modifications and alterations insofar as they come with the scope of the appended claims or the equivalents thereof.

Having thus described the invention, it is now claimed:

1. A seat cushion for use in a wheelchair and the like, said seat cushion comprising:

a shaped-tray, said tray having upper and lower surfaces, said upper surface having recesses to selectively receive the buttocks and thighs of a user of said associated wheelchair;

an envelope, said envelope comprising upper and lower surfaces, said lower surface of said envelope selectively affixed to said upper surface of said shaped tray; and, fill material located within said envelope, said fill material comprising petrolatum and hollow spheres, said spheres mixed with said petrolatum, the volume of said petrolatum not substantially greater than the volume of interstitial spaces of a quantity of spheres alone.

2. A filled envelope for use with an associated chair, said envelope comprising:

upper and lower elements, said upper and lower elements having edges about their peripheries, said edges selectively sealed to form a closed envelope having a finite volume; and, fill material located within said envelope, said fill material being flowably displacable under the weight of an associated user, said fill material comprising petrolatum and lightening means, said lightening means having a low weight density and being interspersed within said petrolatum.

3. The envelope of claim 2 wherein said lightening means comprises hollow glass spheres.

4. The envelope of claim 2 further comprising:

fill spouts, said fill spouts being located in said edges of said upper and lower elements.

5. The envelope of claim 2 wherein said petrolatum has a melting range falling between 95° F. and 170° F.

6. The envelope of claim 2 wherein said petrolatum has a specific gravity between 0.83–0.89 at 60° F.

7. The envelope of claim 2 wherein said upper and lower elements are a urethane blown film.

8. The envelope of claim 2 further comprising:

seams to restrict the flow of said fill material within the right or left side of said envelope.

* * * * *